US005565833A

United States Patent [19]

Leet et al.

[11] Patent Number: 5,565,833

[45] Date of Patent: Oct. 15, 1996

[54] METHOD OF FITTING A COIL ONTO A BOBBIN

[75] Inventors: Edward Leet, Boksburg; Manuel F. V. Ribeiro, Wychwood, both of South Africa

[73] Assignee: Circuit Breaker Industries Limited, South Africa

[21] Appl. No.: 251,382

[22] Filed: May 27, 1994

[30] Foreign Application Priority Data

May 28, 1993 [ZA] South Africa ..... 93/3775

[51] Int. Cl.[6] ..... H01F 7/10

[52] U.S. Cl. ..... 335/250; 336/212

[58] Field of Search ..... 336/192, 208, 336/212; 335/177–9, 200, 202, 250, 251

[56] References Cited

U.S. PATENT DOCUMENTS 5,053,736 10/1991 Fasano ..... 335/177

*Primary Examiner*—Lincoln Donovan

*Attorney, Agent, or Firm*—Ladas & Parry

[57] ABSTRACT

A method of fitting an overload coil for a circuit breaker onto a bobbin assembly. The overload coil is pre-formed into a helical coil with a pair of terminals and a coil sub-assembly is formed by attaching electrical leads to the terminals of the coil. Separate base and top halves of a split bobbin are assembled so that the pre-formed coil of the coil sub-assembly is held captive therebetween. A sensing tube is fitted through an aperture extending axially through the assembled split bobbin, and the sensing tube is mounted onto a magnetic cradle. Different top halves, such as a voltage coil top half and a high inrush top half may be fitted into a common base half. The invention extends to a bobbin assembly for a circuit breaker, as well as to an overload coil sub-assembly.

15 Claims, 4 Drawing Sheets

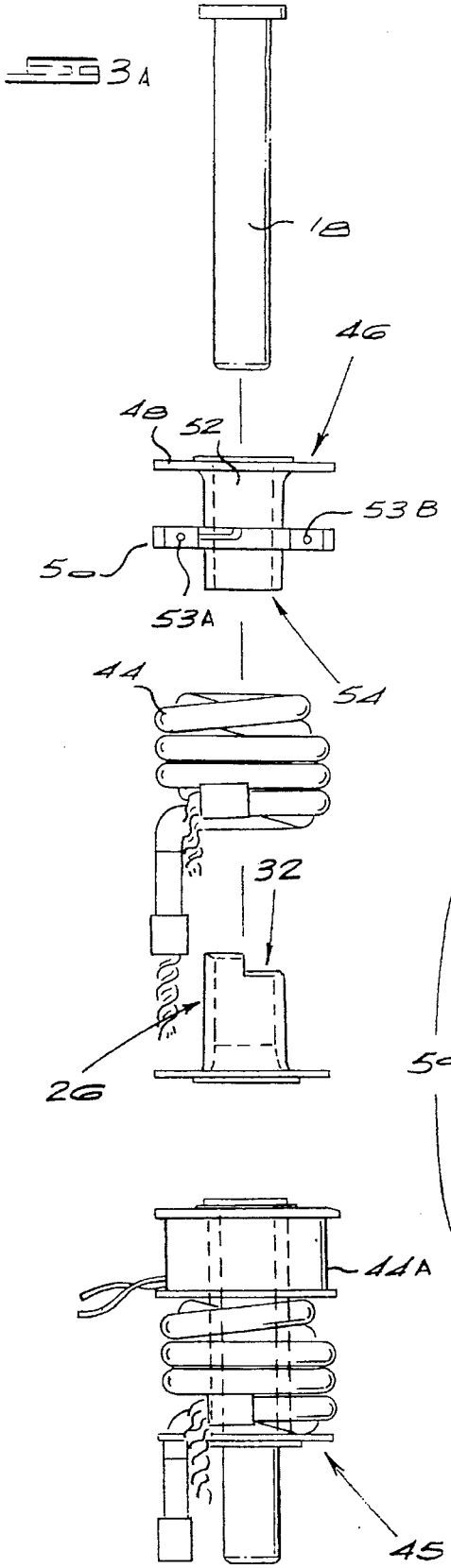
FIG 3A
FIG 3B
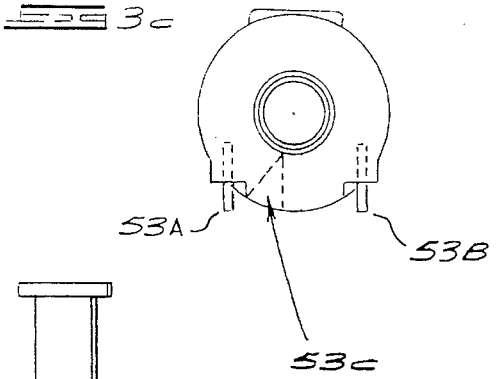
FIG 3C
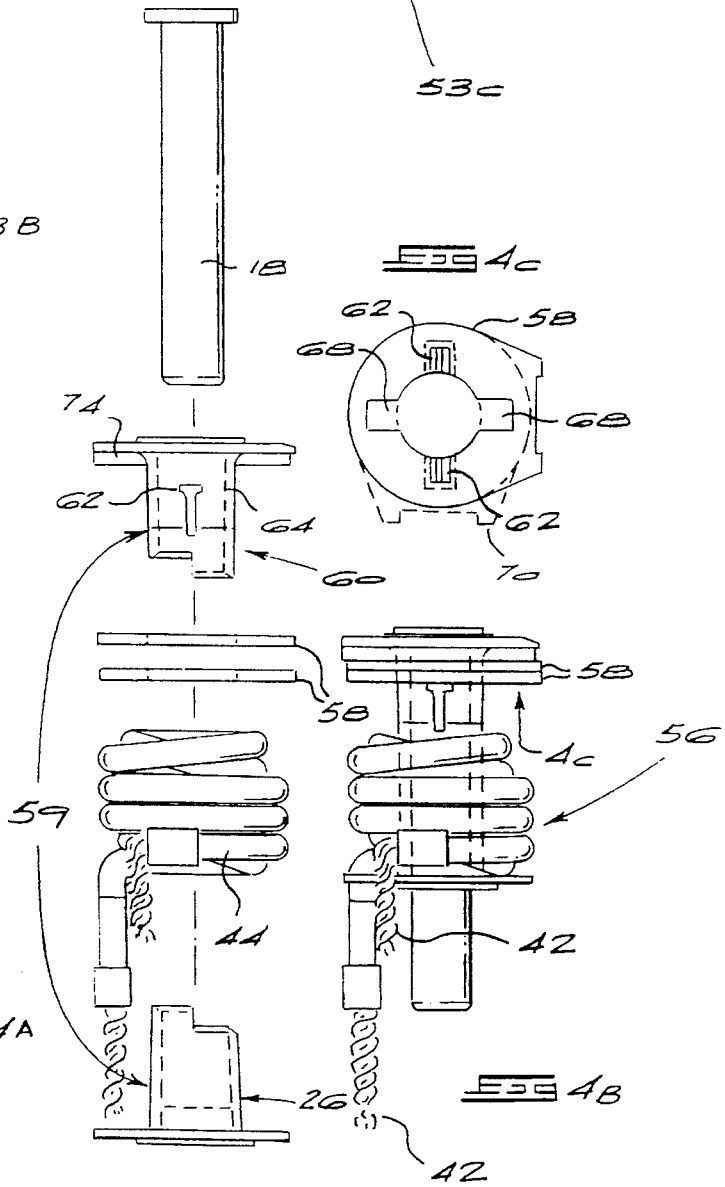
FIG 4A
FIG 4B
FIG 4C

METHOD OF FITTING A COIL ONTO A BOBBIN

BACKGROUND TO THE INVENTION

This invention relates to a method of fitting a coil onto a bobbin, as well as to a circuit breaker coil and bobbin assembly.

Circuit breakers generally make use of an overload coil which is wound onto a bobbin carried on a magnetic frame within the circuit breaker housing. In the assembly procedure, a unitary double-flanged bobbin is typically loaded onto a coil winding machine, and the overload coil is wound onto the bobbin. The necessary coil terminations are completed after the coil and bobbin assembly has been removed from the coil winding machine. A sensing tube is then passed through the coil and bobbin assembly, which is in turn mounted on a magnetic frame.

The loading of the bobbin onto the coil winding machine and the subsequent winding of the coil is a process which does not lend itself to automation, and significant setting-up time is required. In addition, each bobbin has to be manufactured to relatively precise tolerances in order to ensure that it fits onto the coil winding machine. Any additional assembly steps which need to be performed on the overload coil, such as the application of flexible conductors and the like, have to be performed with the bobbin already in position.

SUMMARY OF THE INVENTION

According to the first aspect of the invention there is provided a method of fitting an overload coil for a circuit breaker onto a bobbin assembly comprising the steps of:

a) pre-forming the overload coil into a helical coil with a pair of terminals;

b) forming a coil sub-assembly by attaching an electrical lead to at least one terminal of the coil;

c) providing separate base and top halves of a split bobbin;

d) assembling the base and top halves of the split bobbin so that the pre-formed coil of the coil sub-assembly is held captive therebetween;

e) fitting a sensing tube through an aperture extending axially through the assembled split bobbin; and f) mounting the sensing tube onto a magnetic cradle.

Preferably, the step of forming the coil sub-assembly includes the further steps of attaching electrical leads to both terminals of the coil, and attaching a free end of at least one of the leads to a component of a circuit breaker mechanism prior to assembly of the base and top halves of the split bobbin.

In a preferred form of the invention, the method includes the step of providing a common base half of the bobbin and selecting a dedicated top half of the split bobbin in accordance with the desired performance characteristics of the circuit breaker.

Preferably, the dedicated top half of the split bobbin is selected from a plurality of different dedicated top halves having different functions and configurations, with the axial length of the different top halves being invariant, so that the resultant bobbin assembly has a constant length along its axis regardless of the top half selected so as to accommodate the assembled bobbin in a particular circuit breaker housing.

Typically, the different top halves include a single flanged top half and a double flanged top half defining a sub-spool.

The different top halves may include a high inrush top half, the method including the step of fitting at least one annular shunt plate rotatably to a hub adjacent a flange of the high inrush top half.

In one version of the invention, the sub-spool may be arranged to carry a voltage coil, the method including the step of winding the voltage coil onto the sub-spool prior to assembly of the double flanged top half and the base half of the bobbin.

Typically, the component is a moving contact arm, the method including the step of fitting the moving contact arm to the magnetic cradle after the free end of the one of the leads has been attached to the moving contact arm.

According to a further aspect of the invention there is provided a circuit breaker bobbin assembly comprising a pre-formed helical overload coil having a pair of terminals for receiving electrical leads, a split bobbin formed from separate base and top halves, the top half including a top flange and a tubular semi-hub extending therefrom, and the base half comprising a base flange and a tubular semi-hub extending axially therefrom, each of the semi-hubs terminating in complemental registering formations for preventing rotation of the semi-hubs when they are brought into alignment with one another, a passage being defined through the tubular hubs for accommodating a cylindrical sensing tube, the top and base halves in unassembled form being arranged to allow the pre-formed coil to be fitted therebetween, and in assembled form being arranged to hold the coil captive.

Preferably, the top half of the bobbin comprises the top flange and an intermediate flange spaced from the top flange along the semi-hub so as to define a sub-spool for accommodating a voltage coil.

Typically, a pair of terminal pins are mounted in the intermediate flange, the terminal pins being arranged to receive opposite terminations of the voltage coil.

In one form of the invention, the bobbin assembly comprises a retaining formation extending radially from the semi-hub of the top half of the bobbin and at least one annular shunt plate locatable between an inner surface of the top flange and the retaining formation for forming a high inrush bobbin.

The annular shunt plate typically has a circular aperture formed with a keyed indent which is arranged to be registered with and to fit over the retaining formation, the retaining formation being arranged to retain the shunt plate once the keyed indent has been rotated out of registry with the retaining formation.

Conveniently, the bobbin assembly comprises a pair of endless annular shunt plates, the retaining formation being spaced from an inner surface of the top flange by a gap which is sized to accommodate the contiguous pair of annular shunt plates, the shunt plates being rotatably mounted for allowing varying levels of flux shunting.

The invention further provides an overload coil sub-assembly for a circuit breaker comprising a pre-formed coil having a pair of terminals, a pair of leads connected to the respective pair of terminals, and at least one electromechanical component of a circuit breaker mechanism being attached to a free end of at least one of the leads.

BRIEF DESCRIPTION OF THE DRAWINGS

FIGS. 3A and 3B show respective exploded and assembled side views of a second embodiment of a bobbin assembly of the invention;

FIG. 3C shows an underplan view of a top half of a bobbin forming part of the bobbin assembly of FIGS. 3A and 3B;

FIGS. 4A and 4B show respective exploded and assembled side views of a third embodiment of a bobbin assembly of the invention;

FIG. 4C shows a view of the third embodiment in the direction of the arrows 4C in FIG. 4B;

DESCRIPTION OF EMBODIMENTS

Figures 1A, 1B, 1C, 1D:
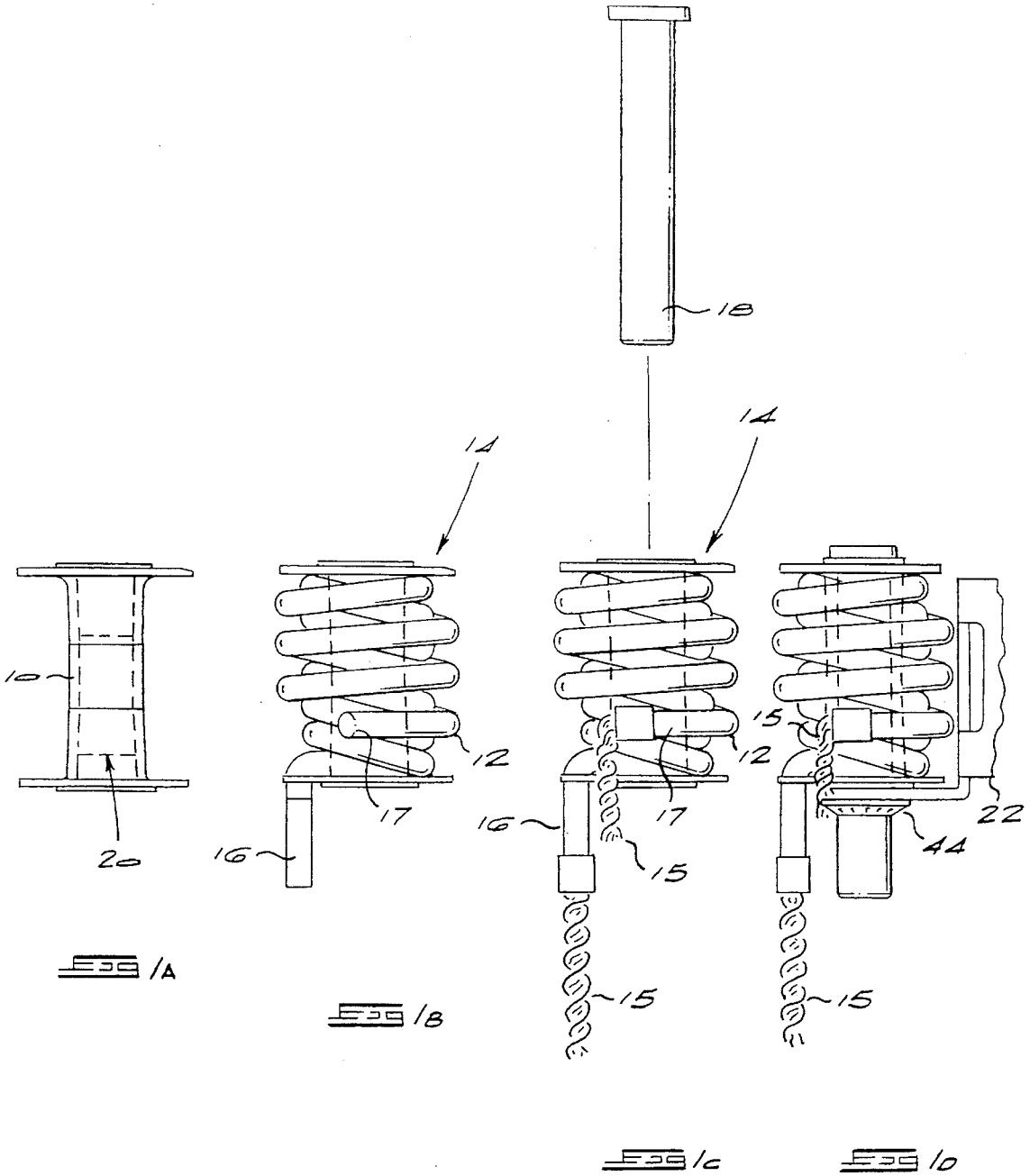
FIG 1D PRIOR ART
FIGS. 1A to 1D show various prior art assembly steps which take place in the winding of a coil onto a conventional one-piece bobbin.

Referring first to FIGS. 1A to 1D, a standard double-flanged one-piece bobbin 10 which is injection moulded from a thermoplastics material is loaded onto a coil winding machine (not indicated), and an overload coil 12 is wound onto the bobbin so as to form a coil and bobbin assembly 14. Flexible conductors 15 are then welded or crimped to the coil terminations 16 and 17 only after the coil and bobbin assembly 14 has been removed from the coil winding machine, as is clear from FIG. 1C. A sensing tube 18 is subsequently passed through a central aperture 20 extending through the bobbin 10, and the resultant coil, bobbin and tube assembly is then mounted onto a magnetic frame 22 which forms part of a circuit breaker mechanism, as can be seen in FIG. 1D.

Referring now to FIGS. 2A to 2E, a split bobbin 24 of the invention is formed from separate base and top halves 26 and 28. The base half has a base flange 29 and a semi-hub 30 extending from the flange 29 and terminating in a stepped formation 32. The top or upper half 28 is similarly provided with a flange 34 and a corresponding semi-hub portion 36 terminating in a complemental stepped formation 38 which forms a complemental fit with the stepped formation 32, so as to index it and prevent rotation of the top and base halves relative to one another. Each semi-hub is tubular in form, with central axially extending apertures 20A being defined therein.

Figures 2A, 2B, 2C, 2D, 2E:
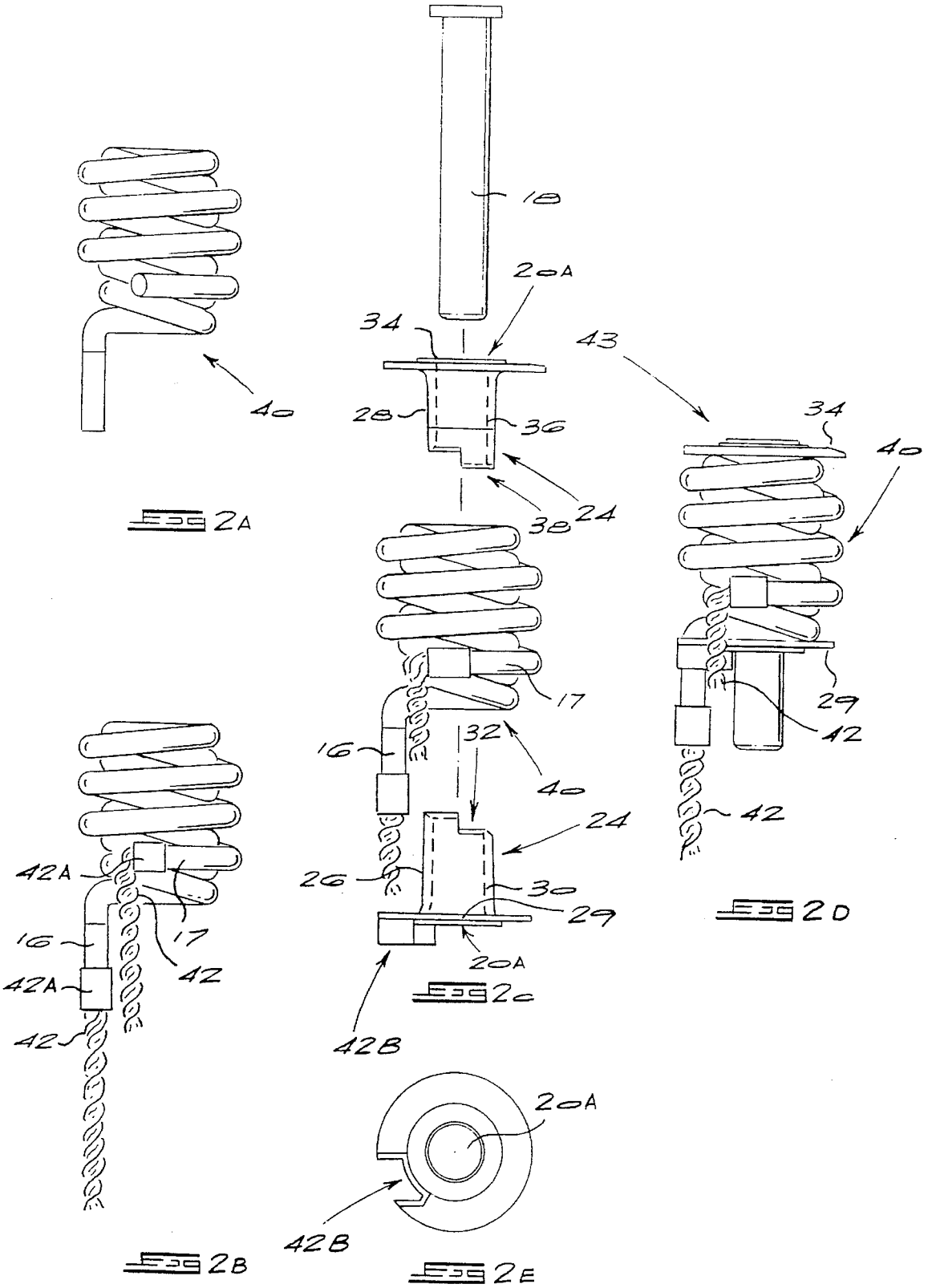
FIGS. 2A to 2D show the assembly of a first embodiment of a split bobbin assembly of the invention.
FIG. 2E shows an underplan view of a base half of the split bobbin.

As is clear from FIG. 2A, a helical overload coil 40 is separately pre-wound on a coil forming jig in a coil winding machine. The wound coil 40 is then removed from the coil winding machine and suitable flexible pigtail conductors or leads 42 are crimped onto the coil terminals 16 and 17 by means of sleeves 42A, as can best be seen in FIG. 2B, so as to form a coil sub-assembly. Alternatively, the ends of the leads may be welded onto position. The coil 40 is then positioned between the base and upper halves 26 and 28 of the bobbin 24, as is clear from FIG. 2C.

The base flange 29 is formed with a walled recess 42B which accommodates the termination 16 so that it is flush or slightly recessed relative to the outer periphery of the flange 29.

The base and top halves of the bobbin are then assembled with the coil arrangement 40 being held captive between them, as is shown in FIG. 2D. The sensing tube 18 may simultaneously be passed through the apertures 20A, in order to assist in alignment of the base and upper halves 26 and 28. The resultant bobbin assembly 43 is then mounted onto the magnetic frame 22 by means of a retaining ring 44 or the like, as per FIG. 1C.

Referring now to FIGS. 3A and 3B, a dual coil configuration is shown incorporating an overload coil 44 and a voltage coil 44A mounted onto a split bobbin 45. A conventional dual coil and bobbin assembly employs a unitary bobbin which is divided into two winding zones by means of three flanges. The overload and voltage coils are wound one-at-a-time directly onto the separate winding zones. The final assembly procedure is similar to that illustrated in FIGS. 1B and 1C, with the flexible pigtail leads being connected up after the overload and voltage coils are in place on the bobbin.

The split bobbin 45 includes the base half 26 and a double flanged top half or sub-spool 46 which has an upper flange 48 and an intermediate auxiliary flange 50 with an auxiliary hub 52 extending between the flanges 48 and 50 and defining a voltage coil forming zone. A pair of terminal pins 53A and 53B extend outwardly from the intermediate flange, and serve as terminals for opposite ends of the voltage coil or winding.

A triangular slot 53C is formed in the intermediate flange, and extends between the pin 53A and the hub 52 of the flange for allowing an interior end of the winding to be brought out from the hub to the pin 53A.

A stepped formation 54 similar to the stepped formation 38 depends from the intermediate flange 50. The voltage coil 44A is wound directly onto the sub-spool 46, and the ends of the coil are affixed to the terminal pins 53A and 53B. As was the case with the overload coil 40, the overload coil 44 is pre-wound and the base and upper bobbin halves 26 and 46 are assembled around the coil in the same manner as previously described with reference to FIGS. 2C and 2D, after the voltage coil has been wound onto the sub-spool. The flexible conductors are connected up to the terminals on the voltage coil prior to assembly of the bobbin halves.

Owing to the fact that the manufacture of the voltage coil is independent of the manufacture of the overload coil, any likelihood of possible damage to the more delicate and sensitive voltage coil during the winding of the overload coil is eliminated. In addition, voltage coils at a given rating may be mass produced, as the voltage coil assembly is independent of the current rating requirements of the overload coil.

Referring now to FIGS. 4A and 4B, a high inrush bobbin and coil assembly 56 is shown incorporating a pair of shunt plates 58. In the assembly of a conventional high inrush coil arrangement, the basic assembly routine illustrated in FIGS. 1A to 1C is followed.

During the prior art assembly process involving a one piece bobbin, ring-type shunt plates may be located over a suitable spigot formation extending from the top of a dedicated bobbin. Alternatively, U-shaped shunt plates may be slotted onto the hub between the upper flange of the bobbin and overload coil, after the coil has been wound onto the bobbin.

As it is clear from FIG. 4A, a high inrush bobbin 59 comprises the common base bobbin half 26 and an upper high inrush bobbin half 60. A pair of shunt plate retaining lugs 62 extend diametrically from the hub 64 of the upper high inrush half 60. As shown in FIG. 4C, the ring-shaped shunt plates 58 are formed with corresponding diametrically extending slots 68 which are arranged to fit over the lugs 62.

During assembly, the shunt plates 58 are registered with and fitted over the lugs, as is indicated in broken outline at 70, and are then rotated through approximately ninety degrees to a position in which they are held captive between the lugs 62 and a ribbed upper flange 74 of the high inrush bobbin half 60. The lower and upper bobbin halves 26 and 60 are then assembled over the overload coil 42, as is shown in FIG. 4B.

As a result of the shunt plate arrangement not being dependent on the current rating of the final coil assembly, the shunt plate and bobbin assemblies can be mass produced. In addition, varying levels of flux shunting can be achieved by being able to adjust the position of the ring-type shunt plates 58 relative to the ribbed flange 74 and the overload coil 42.

In all of the above embodiments the axial lengths of the different top halves are indentical, with the result that the bobbin assembly has a constant length along its axis regardless of the top half selected, so that the assembly may be accommodated in the same circuit breaker housing.

Figure 5:
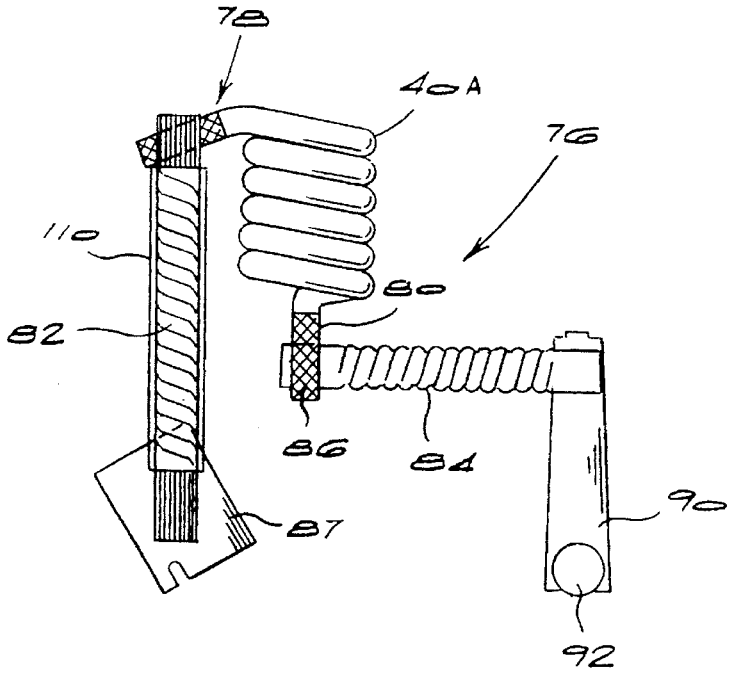
FIG. 5 shows a side view of a coil sub-assembly of the invention.

Referring now to FIG. 5, a coil sub-assembly 76 is shown comprising a pre-formed coil 40A having upper and lower terminals 78 and 80. The pigtail leads 82 and 84 have their ends spot welded or brazed to the respective terminals 78 and 80 after the terminals have been plated with tin 86 so as to assist in the spot welding or brazing process. The opposite end of the pigtail lead 82 is then welded or brazed to the head 87 of a load terminal pin 88, and the opposite end of the other pigtail lead 84 is welded or brazed to one end of a moving contact arm 90, the other opposed end of which is fitted with a contact terminal 92.

Figure 6:
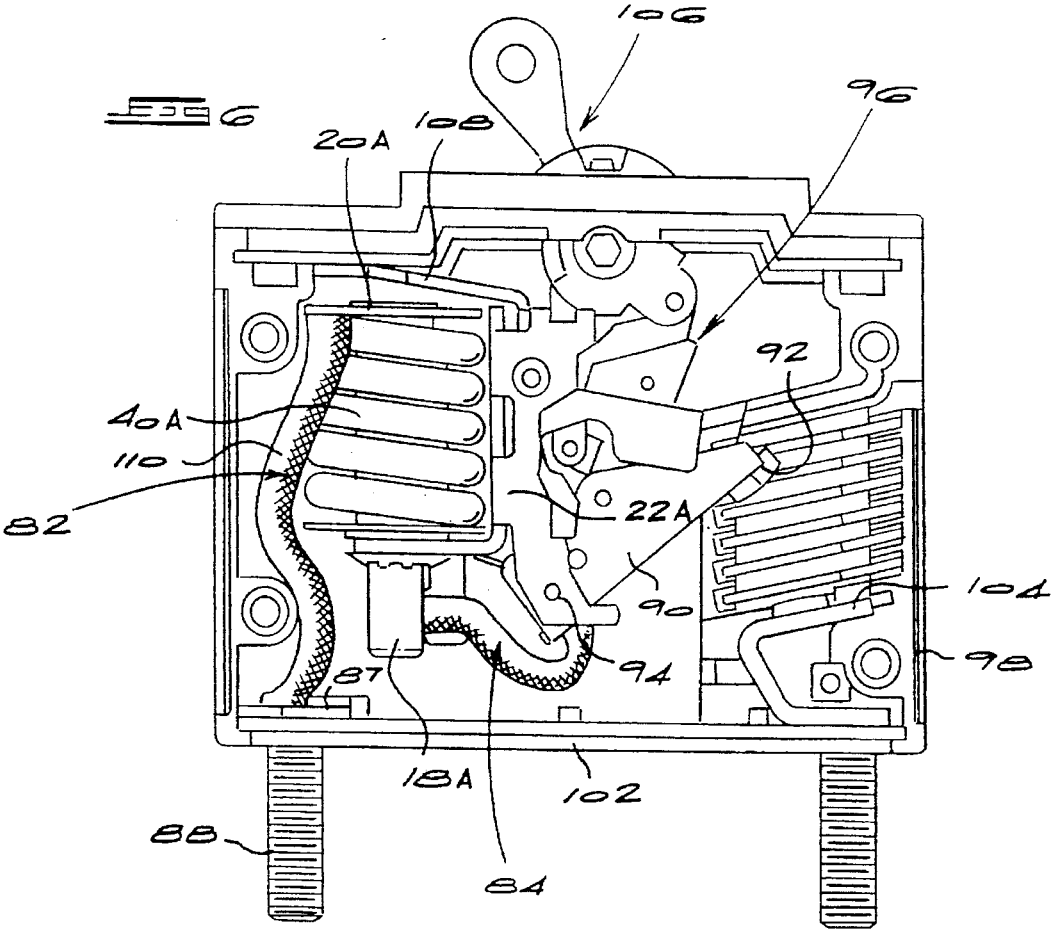
FIG. 6 shows a coil and bobbin assembly incorporating the coil sub-assembly of FIG. 5 and fitted to a circuit breaker mechanism within a circuit breaker housing.

Referring now to FIG. 6, after the coil sub-assembly 76 has been made up, the split bobbin 24 is fitted into position in the manner previously described, after which the sensing tube is passed through the bobbin and is mounted to a cradle 22A in the manner previously described. The moving contact arm 90 is mounted pivotably to a lower limb of the cradle 22A on an axle 94. The entire circuit breaker mechanism 96, the coil sub-assembly 76, the sensing tube 18A and the split bobbin 20A is then assembled in position within one shell half 98 of the circuit breaker housing. The load terminal pin 88 is then fitted through a complemental aperture in the backplate 102 of the circuit breaker housing. The movable contact arm 90 is similarly arranged so that its contact terminal 92 is arranged to move into and out of contact with a stationary terminal 104, depending on whether or not the circuit breaker has been tripped mechanically or electrically by means of the respective toggle switch 106 or current passing through the overload coil 40A. During the assembly process, the sensing tube 18A is generally mounted into position onto the cradle 22A prior to an upper trip lever 108 being mounted pivotably to the cradle 22A. Both the pigtail leads 82 and 84 may be provided with suitable insulating sheaths 110.

Owing to the configuration of the split bobbin, the coil sub-assembly can be manufactured entirely separately. Welding, brazing or even crimping of the ends of the pigtail leads both to the terminals of the coil 40A and to the other components in the circuit breaker mechanism tend to simplify and to facilitate the manufacture and assembly process. In particular, the bobbin does not physically interfere with the welding or brazing process, and is not inclined to get damaged by welding or brazing sputter. The entire coil sub-assembly can be manufactured on a separate production line, thereby speeding up the entire manufacturing and assembly process.

As the split bobbin of the invention does not need to be mounted on a coil winding machine, it can be less robust, thereby utilizing less material. The common base half 26 and the different modular top halves also lead to simplification and reduction in the tooling involved in the manufacture of the various types of bobbin assemblies of the invention. Most of the components used to manufacture different bobbin assemblies are invariant. The only components which do vary are the top half of the bobbin assembly and the pre-formed coil. Consequently, production runs of the common components may be increased, the assembly of the dedicated components involves a selection process, and the modular nature of the dedicated components facilitate separate sub-assembly routines which may be run in parallel.

We claim:

1. A method of fitting an overload coil for a circuit breaker onto a bobbin assembly comprising the steps of:

a) pre-forming the overload coil into a helical coil with a pair of terminals;

b) forming a coil sub-assembly by attaching an electrical lead to at least one terminal of the coil;

c) providing separate base and top halves of a split bobbin;

d) assembling the base and top halves of the split bobbin so that the pre-formed coil of the coil sub-assembly is held captive therebetween;

e) fitting a sensing tube through an aperture extending axially through the assembled split bobbin; and f) mounting the sensing tube onto a magnetic cradle.

2. A method according to claim 1 in which the step of forming the coil sub-assembly includes the further steps of attaching electrical leads to both terminals of the coil, and attaching a free end of at least one of the leads to a component of a circuit breaker mechanism prior to assembly of the base and top halves of the split bobbin.

3. A method according to claim 1 which includes the step of providing a common base half of the bobbin and selecting a dedicated top half of the split bobbin in accordance with the desired performance characteristics of the circuit breaker.

4. A method according to claim 3 in which the dedicated top half of the split bobbin is selected from a plurality of different dedicated top halves having different functions and configurations, with the axial length of the different top halves being invariant, so that the resultant bobbin assembly has a constant length along its axis regardless of the top half selected so as to accommodate the assembled bobbin in a particular circuit breaker housing.

5. A method according to claim 4 in which the different top halves include a single flanged top half and a double flanged top half defining a sub-spool.

6. A method according to claim 4 in which the different top halves include a high inrush top half, the method including the step of fitting at least one annular shunt plate rotatably to a hub adjacent a flange of the high inrush top half.

7. A method according to claim 5 in which the sub-spool is arranged to carry a voltage coil, the method including the step of winding the voltage coil onto the sub-spool prior to assembly of the double flanged top half and the base half of the bobbin.

8. A method according to claim 2 in which the component is a moving contact arm, the method including the step of fitting the moving contact arm to the magnetic cradle after the free end of the one of the leads has been attached to the moving contact arm.

9. A circuit breaker bobbin assembly comprising a pre-formed helical overload coil having a pair of terminals for receiving electrical leads, a split bobbin formed from separate base and top halves, the top half including a top flange and a tubular semi-hub extending therefrom, and the base half comprising a base flange and a tubular semi-hub extending axially therefrom, each of the semi-hubs terminating in complemental registering formations for preventing rotation of the semi-hubs when they are brought into alignment with one another, a passage being defined through the tubular hubs for accommodating a cylindrical sensing tube, the top and base halves in unassembled form being arranged to allow the pre-formed coil to be fitted therebetween, and in assembled form being arranged to hold the coil captive.

10. A bobbin assembly according to claim 9 in which the top half of the bobbin comprises the top flange and an intermediate flange spaced from the top flange along the semi-hub so as to define a sub-spool for accommodating a voltage coil.

11. A bobbin assembly according to claim 10 in which a pair of terminal pins are mounted in the intermediate flange, the terminal pins being arranged to receive opposite terminations of the voltage coil.

12. A bobbin assembly according to claim 9 which comprises a retaining formation extending radially from the semi-hub of the top half of the bobbin and at least one annular shunt plate locatable between an inner surface of the top flange and the retaining formation for forming a high inrush bobbin.

13. A bobbin assembly according to claim 12 in which the annular shunt plate has a circular aperture formed with a keyed indent which is arranged to be registered with and to fit over the retaining formation, the retaining formation being arranged to retain the shunt plate once the keyed indent has been rotated out of registry with the retaining formation.

14. A bobbin assembly according to claim 13 which comprises a pair of endless annular shunt plates, the retaining formation being spaced from an inner surface of the top flange by a gap which is sized to accommodate the contiguous pair of annular shunt plates, the shunt plates being rotatably mounted for allowing varying levels of flux shunting.

15. An overload coil sub-assembly for a circuit breaker comprising a pre-formed helical coil having a pair of terminals, a pair of leads connected to the respective pair of terminals, and at least one electromechanical component of a circuit breaker mechanism being attached to a free end of at least one of the leads, the coil being arranged to receive separate halves of a split bobbin.

* * * * *